US012428848B2

(12) United States Patent
Brabant et al.

(10) Patent No.: US 12,428,848 B2
(45) Date of Patent: Sep. 30, 2025

(54) SLAT ROOF FOR A CANOPY, KIT OF PARTS FOR ASSEMBLING THE SLAT ROOF, CANOPY COMPRISING THE SLAT ROOF

(71) Applicant: RENSON SUNPROTECTION-SCREENS, Waregem (BE)

(72) Inventors: Pieter Leopold André Brabant, Rumbeke (BE); Kristof Lemiegre, Gentbrugge (BE)

(73) Assignee: RENSON OUTDOOR NV, Kruisem (BE)

( * ) Notice: Subject to any disclaimer, the term of this patent is extended or adjusted under 35 U.S.C. 154(b) by 151 days.

(21) Appl. No.: 18/031,960

(22) PCT Filed: Oct. 20, 2021

(86) PCT No.: PCT/IB2021/059648
§ 371 (c)(1),
(2) Date: Apr. 14, 2023

(87) PCT Pub. No.: WO2022/084871
PCT Pub. Date: Apr. 28, 2022

(65) Prior Publication Data

US 2023/0392381 A1 Dec. 7, 2023

(30) Foreign Application Priority Data

Oct. 22, 2020 (BE) ..... 2020/5737

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04B 7/163
See application file for complete search history.

(56) References Cited

U.S. PATENT DOCUMENTS 3,219,101 A * 11/1965 Prehn ..... E04F 10/10 160/206
2008/0245489 A1* 10/2008 Chuang ..... E06B 7/08 160/236

(Continued)

FOREIGN PATENT DOCUMENTS

BE 1023136 A1 11/2016
BE 1024225 A1 12/2017
FR 2947845 A1 1/2011

OTHER PUBLICATIONS

International Search Report for PCT Application No. PCT/IB2021/059648, dated Jan. 27, 2022, 12 pages.

*Primary Examiner* — Beth A Stephan
(74) *Attorney, Agent, or Firm* — Dickinson Wright PLLC

(57) ABSTRACT

A slat roof with two substantially parallel beams with a set of parallel slats between them that are rotatably secured to the beams is disclosed. A first beam comprises a set of recesses that are open towards the topside. Each slat has at its extremities a slat shaft, wherein the first slat shaft rests in a corresponding recess. At least one recess is provided with an abutment and the slat shaft that is positioned in the recess is provided with a locking piece that at its topside at least partially abuts against the abutment. The locking piece and the abutment together ensure vertical locking of the first extremity of the slat.

20 Claims, 14 Drawing Sheets

(56) References Cited

U.S. PATENT DOCUMENTS

| | | | | |
|---|---|---|---|---|
| 2018/0202155 | A1* | 7/2018 | Abeel | E04B 1/388 |
| 2019/0338528 | A1* | 11/2019 | Torman | E04F 10/10 |
| 2021/0332587 | A1* | 10/2021 | Geriavenko | E04F 10/10 |
| 2021/0363752 | A1* | 11/2021 | Wagaman | E04F 10/10 |
| 2023/0358053 | A1* | 11/2023 | Fang | E04F 10/10 |
| 2023/0417060 | A1* | 12/2023 | Hong | E04F 10/10 |

* cited by examiner

SLAT ROOF FOR A CANOPY, KIT OF PARTS FOR ASSEMBLING THE SLAT ROOF, CANOPY COMPRISING THE SLAT ROOF

CROSS-REFERENCE TO RELATED APPLICATION(S)

This present application is a national stage application of International Patent Application No. PCT/IB2021/059648, filed Oct. 20, 2021, which claims priority to Belgium Patent Application No. BE2020/5737, filed Oct. 22, 2020, the disclosures of which are hereby incorporated by reference in their entireties.

TECHNICAL FIELD OF THE INVENTION

The present invention relates to a slat roof for a canopy. The present invention also relates to a kit of parts for assembling the slat roof and a canopy comprising the slat roof.

STATE OF THE ART

Canopies are generally put up to protect an outside area or simply to free up this space. Such canopies are often set up in this way at homes, restaurants, shops, etc. to protect an outdoor terrace or the like from the sun, precipitation and/or wind or simply to let the sun in for a while. These canopies can, for example, be constructed in the form of an awning, a pergola, a veranda, a car port, a pavilion, etc.

Such a canopy typically comprises a roof construction that is generally composed of multiple beams assembled to form one or more frames in which a roof infill can be secured. The actual beams are often a combination of a multiple individual profiles. Such a roof construction is typically supported by four (or more) columns between which a wall infill can be provided. Fewer columns can also be used in the event that the roof construction is (also) supported by other structures, such as a wall of an existing structure. Exceptionally, the roof construction can also be supported by another roof structure such that no columns are present.

In such a canopy it is possible to provide a roof infill and/or one or more wall infills. A wall infill can be fixed or moveable, for example a sliding roof. The roof infill of a sliding roof can, for example, consist of a retractable canvass or screen, slats rotating around their axis, or segments able to slide over one another. The segments can be panels that are partially made of (laminated) glass or plastic, such as PC or PMMA. Depending on the choice of material, the light transmission and the robustness of the roof can be matched to the desired application. A wall infill can similarly be fixed or moveable. Examples include a retractable roof or screen or moveable, i.e. sliding or folding, panels.

In the context of a roof construction for canopies there are typically four orientations involved (namely above, below, outside, and inside) for the frame of the roof construction. Here, "above" refers to the part of the roof construction which is or will be oriented towards the upper surface (i.e. the sky, e.g. the open air), "below" to the part of the roof construction which is or will be oriented towards the lower surface (i.e. the ground, e.g. the terrace floor), "outside" to the part of the roof construction which is or will be oriented away from the roof (i.e. away from the roof infill) and "inside" to the part of the roof construction which is or will be oriented towards the inner side of the roof (i.e. directed towards the roof infill).

The present invention relates to a roof construction in the form of a slat roof wherein the roof infill is of the type that is formed by a plurality of parallel slats which at their extremities are rotatably secured to beams forming part of a frame. The slats are rotatable between an open position and a closed position. In the open position there is a gap between the slats through which, for example, light can be introduced into the space below, or leave this space below. In the closed state the slats form a closed canopy by means of which the space below can be protected from, for example, wind and/or precipitation, such as rain, hail or snow. To drain away precipitation the slats are typically assembled sloping towards one of the two beams.

A known slat roof comprises a frame provided with a first and a second beam which are substantially parallel and extend in a transverse direction, wherein the beams have a topside, an underside, an inside and an outside, wherein the insides of the beams face each other and wherein the first beam is provided with a set of recesses that are open towards the topside of the first beam and the second beam with a set of openings. The slat roof also comprises a set of parallel slats positioned between the beams, wherein the slats extend in a longitudinal direction and are provided with a first extremity with a first slat shaft and a second extremity with a second slat shaft, wherein each of the first slat shafts is passed through a corresponding one of the set of recesses and each of the second slat shafts through a corresponding one of the set of recesses such that the slats are rotatably secured to the beams.

The advantage of the recesses in the first beam is that the slats can be easily fitted between the beams. In particular, the second slat shaft is passed through a corresponding opening in the second beam and the first slat shaft is positioned from the topside in a corresponding recess in the first beam. It is therefore not necessary, as is the case in certain slat roofs (see, for example, the slat roof disclosed in patent application BE 1024225 A1), to pass the second slat shaft sufficiently far through the opening that the first slat shaft can be positioned in the first beam.

The disadvantage in using recesses is that the first extremity of the slat (i.e. the first slat shafts) is not locked vertically in relation to the first beam. More specifically, wind loads and/or other external forces may ensure that an upward force is exerted on the slats and that the first slat shafts are therefore lifted from the recesses, causing damage to the slat roof.

In the known slat roof, therefore, vertical locking is provided for the first slat shafts. This takes the form of a separate cover profile that is secured by screws on the topside of the first beam and thus forms part of the topside of the first beam. In particular, the screws are passed vertically through the cover profile and are screwed tightly through a flat wall of the first beam. An upward force exerted on the slats is contained by the cover profile. The necessary electrical and electronic components for driving the slats are also located beneath the cover profile.

A similar slat roof is disclosed in FR 2 947 845 A1, where a cover profile is secured by means of a snap-lock mechanism to the beam.

The known cover profile has a number of disadvantages.

Firstly, it is time-consuming to assemble such a cover profile by means of a plurality of screws, which screws are necessary for offering sufficient resistance to high wind loads. Moreover, if there is a technical defect in, and/or necessary maintenance has to be carried out on, one of the first slat shafts, an electrical component and/or and electronic component, the complete cover profile has to be removed. This is time-consuming, given the presence of the many screws. In addition, it has been shown that, with repeated removal and replacement of the screws, the first beam becomes damaged so that it is no longer possible, or at least is very difficult, to correctly secure the screws. Furthermore, in practice it has also been shown that the vertical locking by the cover profile is inadequate at higher winds loads of 150 km/h and above, which wind loads may arise during storms, hurricanes and the like.

A further problem with such slat roofs is that under the weight of the slats secured between them, the beams bend outwards and therefore become convex. Wind loads can also cause and/or exacerbate this phenomenon. Given the trend towards designing larger continuous slat roofs and/or using heavier slats (such as, for example, glass slats) this is a highly relevant problem. A number of solutions for this problem are already known.

One solution for remedying this problem is to design the beams to be more robust to reduce their outward bending. This requires more material, however, and means that the beams become considerably more expensive, which also results in a significant increase in the cost of the slat roof. Broader and heavier beams are often also undesirable for aesthetic reasons.

It is also known to position the beams against the bulge (i.e. in a concave manner seen from the inside of the roof construction) such that the bulge makes them straight again. However, it is difficult to connect such beams neatly with other beams that together form a frame for the slat roof. In particular, this is because such beams are difficult to incorporate together in an aesthetic way when mitred.

It is furthermore known to introduce a cross beam in the centre of such a slat roof. However, most people do not want their slat roof to have such a division as a result of a cross beam.

Another solution is disclosed in patent application BE 1023136 A1. The solution is based on the use of a tension cable that is placed in a hollow slat shaft. However, this solution cannot be applied equally well to all slat roofs. In particular, this solution is less well suited to relatively simple slat roofs wherein the beams are made in a single piece as a result of which the extremities of these tension cables cannot (easily) be concealed in the beams.

Another solution is disclosed in patent application BE 1024225 A1. This solution is based on the provision of radial projections on the slat shafts and providing the shaft openings in the beams with the necessary form (e.g. a keyhole form) so that the slat shafts with radial projections are able to pass through them. Once the slat shafts have been positioned, they are then rotated into a locked state so that the radial projections touch against a circumferential wall of the beams around the shaft openings. A disadvantage of this solution is that the slat shaft, for example under the influence of wind loads or other external forces, can be rotated back out of its locked state so that the radial projections no longer touch against the beams.

DESCRIPTION OF THE INVENTION

It is an aim of the present invention to solve one or more of the above problems at least in part.

This aim is achieved in that the first beam of the slat roof, near to at least one recess from said set of recesses, is provided with an abutment and that the slat shaft that is placed in said recess is provided with a locking piece that at its topside at least partially abuts against said abutment.

The provision of a locking piece on the first slat shaft and a corresponding abutment on the first beam results in vertical locking of the first slat shaft (i.e. in vertical locking of the first extremity of the slat) in relation to the first beam without the need for a cover profile. The disadvantages described above of the cover profile that also serves as a vertical lock are therefore avoided while the advantages of the placement of the beams by using recesses in the first beam and openings in the second beam are retained.

When the cover profile is used as a vertical lock the maximum force is determined by the screws and the material of the first beam (typically aluminium). The maximum force that can be absorbed by the locking piece and the abutment according to the present invention is primarily dependent upon the materials and design selected. In other words, the present invention offers greater design freedom for the locking piece and the abutment and allows locking to be provided which is able to absorb a higher force than the known locking by means of screws.

It should furthermore be noted that, though a cover profile is not necessary according to the present invention, the beams of a slat roof are typically still provided with a cover profile. This then serves to protect internal components in the first beam (such as the slat shafts, the electrical components and the electronic components) from the outside environment and/or to keep these from view. However, because the cover profile no longer serves as a vertical lock, there is no further need to secure the cover profile with a plurality of screws, with a simple snap-on connection (or the like) being sufficient. This allows the cover profile to be secured to the beam quickly and easily, in particular without tools.

In addition, it is advantageous that each slat has an individual vertical lock. This means that only one lock has to be removed if a slat has to be replaced without having to spend time detaching the other slats.

In an embodiment of the present invention the locking piece has a transversally, in relation to the longitudinal direction, oriented wall that on its inside at least partially abuts against the beam.

A wall oriented in this way serves as a lateral lock of the first beam against the outward bending of the first beam. More specifically, the locking piece acts in a similar way to the radial projections disclosed in BE 1024225 A1 in the sense that the locking piece (which is itself secured in relation to the first slat shaft in the longitudinal direction) prevents the first beam from not being able to slide in relation to the first slat shaft in the longitudinal direction towards the outside of the frame. In this embodiment the locking piece together with the beam thus serves both as a vertical lock and lateral (i.e. in the longitudinal direction) lock.

In an embodiment of the present invention said abutment is at least partially formed by an substantially flat wall section of the first beam and the locking piece, on its topside, has a corresponding substantially flat wall section.

An abutment formed by two surfaces that push against each other is advantageous because additionally it can also absorb rotational forces about the longitudinal direction on the locking piece.

In a preferred embodiment of the present invention, the locking piece comprises a protrusion extending towards said topside from said substantially flat wall section, wherein the first beam is provided with a sloping wall section that substantially joins said substantially flat wall section and wherein said protrusion has a corresponding sloping wall section that abuts against the sloping wall section.

The sloping wall sections on both the beam and the locking piece have the additional advantage that they contribute both to the vertical and the lateral locking. The desired functionality of the locking piece can therefore be provided by one wall section. Moreover, this is a particularly efficient design because the various walls that serve as abutment walls merge into each other and so no unused wall sections are provided which unnecessarily increase the size of the locking piece. Moreover, the protrusion increases the strength of the substantially flat wall section of the locking piece, which wall section abuts against the beam.

In an advantageous embodiment of the present invention, said transversally oriented wall comprises a first wall section and a second wall section, which wall sections have a different clearance from the slat in the longitudinal direction and a different clearance in relation to the topside of the frame, which second wall section is preferably formed by a protrusion that is positioned on the topside of the locking piece.

The use of two wall sections is advantageous because this contributes to the absorption of possible torsional forces. As a result of the different positioning of the wall sections, for example the first wall section tight against the slat at a first height and the second wall section further from the slat at a higher position than the first height, there are two different lateral abutment points of the locking piece against the beam. Depending on the direction of the force exerted on the slat one or the other abutment point will absorb the majority of the force exerted.

In an embodiment of the present invention the slat shaft placed in said recess is provided with a connection piece that is placed in said recess, wherein the locking piece is secured by means of said connection piece to the slat shaft.

The connection piece allows the locking piece to be secured to the slat shaft without having to adapt the form of the slat shaft such that all slat shafts can have the same form. This pushes down the production cost of the roof construction. Moreover, both the first slat shaft and the connection piece can be secured to the slat before placing the slat in the recess. Such pre-assembly reduces the time needed to build the roof construction.

In an advantageous embodiment of the present invention, the locking piece is displaceable in relation to the connection piece in the longitudinal direction between a loose state and a locked state, wherein, in the locked state, the locking piece at its topside at least partially abuts against said abutment and, in the loose state, the locking piece does not touch against said abutment and in particular not against the beam.

This design allows the locking piece, during the placement of the slat (on which the first slat shaft is typically already assembled), to be placed in its loose state. In the loose state there is no interaction between the locking piece and the abutment on the first beam, such that the first extremity of the slat can be placed in the recess provided for this purpose. Following placement of the slat the locking piece is shifted over the connection piece to its locked state (i.e. the locking piece is shifted towards the slat) such that the first extremity of the slat is vertically secured in relation to the first beam and wherein preferably the first beam is also secured laterally in relation to the slat. Displacement of the locking piece is a simple operation that can be performed without tools and therefore also takes little time during assembly.

Furthermore, it is also simple to release the locking piece from its locked state again. Hence, this allows simple replacement of a slat if this should be necessary.

In a more advantageous embodiment of the present invention, the locking piece is provided with a first connecting means and the connection piece is provided with a second and a third connecting means, wherein, in the loose state, the locking piece is positioned on the connection piece by means of the first and the second connecting means and wherein, in the locked state, the locking piece is positioned on the connection piece by means of the first and the third connecting means. Preferably, the first connecting means is formed by at least one hook, the second connecting means by at least one notch corresponding with the hook, and the third connecting means by at least one further notch corresponding with the hook, wherein, when displacing the locking piece from its loose state to its locked state, said at least one hook at least partially undergoes a transversal displacement in relation to the longitudinal direction.

The use of the same first connecting means on the locking piece for the securing of the locking piece to the connection piece in two different states is advantageous because this reduces the number of connecting means required. Preferably, the connection piece is provided with two notches located at different distances from the slat in the longitudinal direction so that a hook on the locking piece can easily grip at that point.

In a further advantageous embodiment of the present invention, the notch and/or the further notch are formed by a groove in the circumferential wall of the connecting piece.

A groove allows multiple hooks to grip the same structure. Moreover, this allows the multiple hooks to be placed asymmetrically in relation to the longitudinal direction in the groove for an optimum connection between the locking piece and the connection piece.

In a further advantageous embodiment of the present invention, the locking piece is formed by an annular body, wherein said first connecting means is secured to the annular body by means of an arm extending in the longitudinal direction.

The use of an annular body makes it simple to slide the locking piece over the slat shaft and the connection piece. Moreover, the arm has a simple design that allows the hook (or hooks) to displace transversally in relation to the connection piece for the purpose of displacing between the loose state and the locked state.

In an advantageous embodiment of the present invention, the connection piece has a transversally, in relation to the longitudinal direction, oriented wall which at least partially touches against a perimeter wall of said recess.

Just like the transversally oriented wall of the locking piece, this transversally oriented wall of the connection piece contributes to the lateral locking of the first beam in relation to the slat.

In an advantageous embodiment of the present invention, the locking piece and/or the connection piece are manufactured as an integral part, in particular by means of injection moulding, from a plastic.

Injection moulding is a known method for mass production of plastic parts such that the production costs of the locking piece and/or the connection piece remain limited. The integral manufacturing of the locking piece and/or the connection piece increases their strength. Moreover, there are many plastics (wherein the term plastic should be interpreted widely and also includes fibre-reinforced plastics or plastics reinforced in another way that are available for the skilled person to choose from in respect of both the desired strength and a sufficiently flexible locking piece that, if desired, is slidable in relation to the connection piece. The use of a plastic is also advantageous compared with other materials (such as metal) in terms of production costs, durability and the desired elastic properties.

In an embodiment of the present invention, the first beam, near to multiple, preferably all, recesses from said set of recesses, is provided with an abutment and the slat shafts that are placed in said recesses are each provided with a locking piece that at its topside at least partially abuts against a corresponding abutment.

The addition of vertical locking for multiple slats in relation to the first beam increases the maximum wind load that the roof construction can withstand. In particular, it has been shown that the roof construction according to the present invention is able to withstand wind loads of up to 200 km/h and more in the event of each of the beams being provided at its first extremity with a locking piece for the vertical locking.

In an advantageous embodiment of the present invention, all stops are formed by means of an substantially flat wall section extending in said transverse direction.

This allows that wall section, together with the rest of the first beam, to be formed by means of an extrusion process after which the necessary recess is provided (for example by drilling or milling). The combination of all stops in a single wall section therefore allows the first beam to be manufactured with the known production techniques.

In an embodiment of the present invention, the second beam is provided with a set of openings, wherein each of the second slat shafts is passed through a corresponding opening in the set of openings and wherein at least one second slat shaft of said second slat shafts is provided with a positioning element, in particular a clip, that directly or indirectly abuts against a perimeter wall of the second beam around the opening through which said second slat shaft is passed.

The positioning element serves for lateral locking of the second beam in relation to the slat. More specifically, the positioning element acts in a similar way to the radial projections disclosed in BE 1024225 A1 in the sense that the positioning element (which is itself secured in relation to the second slat shaft in the longitudinal direction) prevents the second beam from not being able to slide in relation to the second shaft in the longitudinal direction towards the outside of the frame.

This embodiment is in particular advantageous if the slat at its first extremity is provided with a locking piece with a transversally, in relation to the longitudinal direction, oriented wall. In this way, the positioning element on one side and the locking piece on the other side ensure that the beams are not able to displace outwards in relation to the slat.

In an advantageous embodiment of the present invention, the second slat shaft is provided with a transversally, in relation to the longitudinal direction, oriented wall against which the positioning element at least partially abuts upon displacement thereof towards the outside of the beam. Preferably, this transversally oriented wall is formed by a groove in the second slat shaft.

Such a wall serves as an abutment for the positioning element and prevents a displacement thereof towards the outside of the beam. Such a groove has a simple form to which a clip can be secured.

In an advantageous embodiment of the present invention, a bearing piece extends though said opening through which said second slat shaft is passed, wherein the positioning element abuts against the bearing piece. Preferably, the bearing piece is provided with a groove in its circumferential wall, wherein a section of the second beam is located in said groove.

The bearing piece ensures a smooth rotation of the slat shaft in relation to the second beam. In this design the positioning element serves to ensure indirect locking laterally though the bearing piece, which bearing piece in turn locks the beam laterally. For the lateral locking of the bearing piece and the second beam it is advantageous that the second beam is partially located in a groove of the bearing piece given that this offers locking in both directions along the longitudinal direction.

In an advantageous embodiment of the present invention, multiple said second slat shafts are provided with a positioning element, in particular a clip, that directly or indirectly abuts against a perimeter wall of the second beam around the opening through which said second slat shaft is passed.

Splitting the lateral locking over multiple positioning elements reduces the force exerted per positioning element. The positioning elements can therefore be manufactured to be less rigid (for example from cheaper materials, such as plastic, and/or in a smaller size), which pushes down the overall cost of the roof construction.

The advantages described above are also achieved with a kit of parts for assembling a roof construction as described above, wherein the kit comprises the frame, the first beam, the second beam, the slats and at least one locking piece.

The advantages described above are also achieved with a canopy comprising a roof construction as described above.

BRIEF DESCRIPTION OF THE DRAWINGS

The invention will be explained in more detail below on the basis of the following description and the accompanying drawings.

EMBODIMENTS OF THE INVENTION

Figure 1:
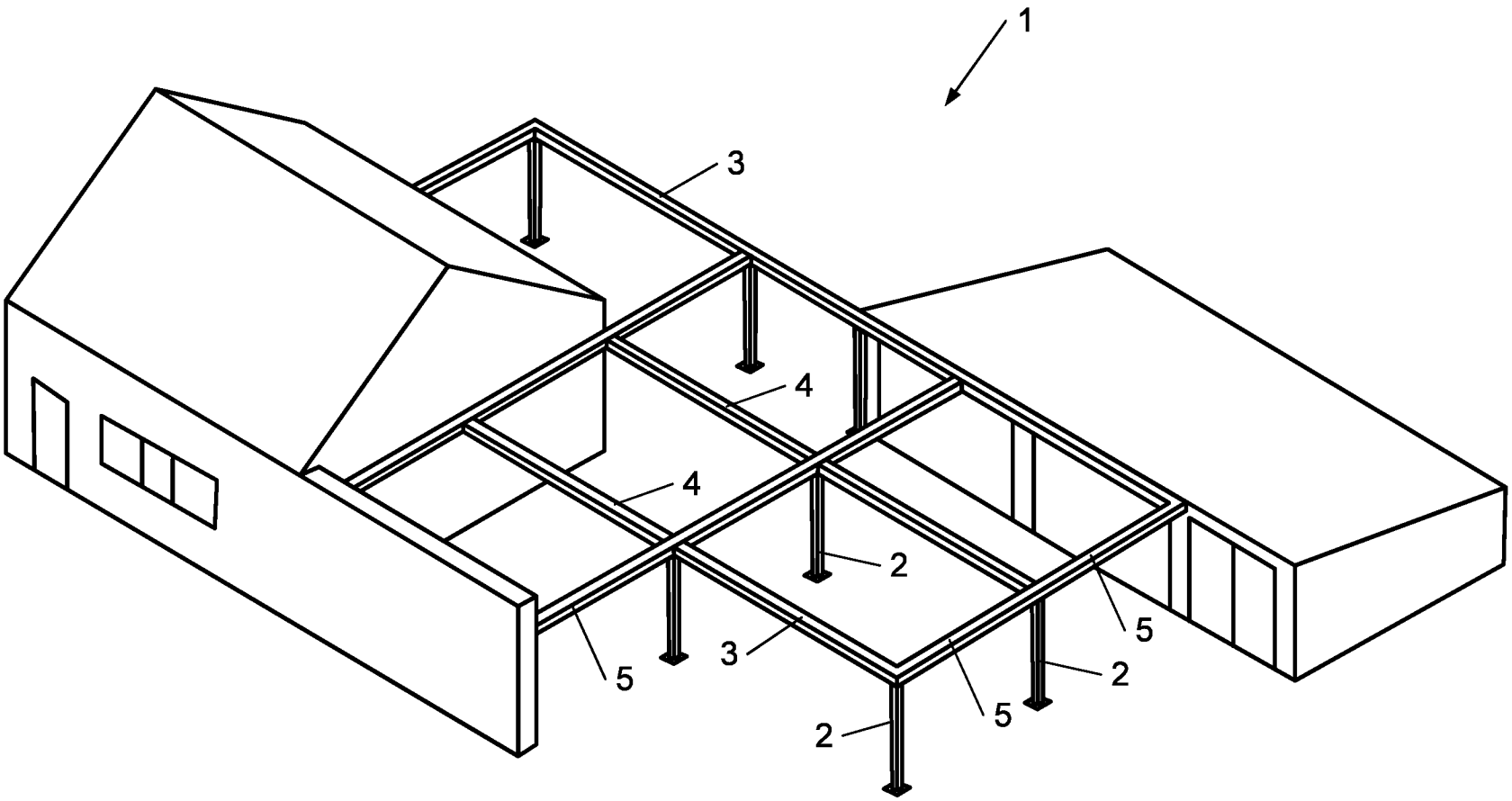
FIG. 1 shows a schematic view of a canopy.

The present invention will be described below on the basis of specific embodiments and with reference to particular drawings, but the invention is not limited to these and is solely defined by the claims. The drawings shown here are solely schematic views and are not restrictive. In the drawings, the dimensions of certain components may be shown enlarged, meaning that the components in question are not shown to scale, but solely for the purpose of illustration. The dimensions and the relative dimensions do not necessarily correspond with the actual practical implementations of the invention.

Moreover, terms such as “first”, “second”, “third” and the like in the description and in the claims are used to make a distinction between similar elements and do not necessarily indicate a sequential or chronological order. The terms in question are interchangeable in the appropriate circumstances, and the embodiments of the invention can work in sequences other than those described here.

The term "comprising" and derivations thereof, as used in the claims, must not be interpreted as being restricted to the means that are indicated thereafter each time; the term does not exclude other elements or steps. The terms must be interpreted as a specification of the indicated characteristics, integers, steps, or components to which reference is made, but without the presence or addition of one or more additional characteristics, integers, steps, components, or groups thereof being excluded. The scope of an expression such as "a device comprising means A and B" is in this case also not exclusively restricted to devices that purely consist of components A and B. In contrast, what is meant is that, as regards the present invention, the only relevant components are A and B.

The term "substantially" comprises variations of +/−10% or less, preferably +/−5% or less, more preferably +/−1% or less, and more preferably still +/−0.1% or less, of the specified state, in so far as the variations are applicable for operation in the present invention. The term "substantially A" should be understood to also comprise "A".

FIG. 1 illustrates a canopy 1 for a ground surface, for example a terrace or garden. The canopy comprises a plurality of columns 2 supporting various beams 3, 4, 5. The columns and beams together form frames to which wall infills 6 and/or roof infills 7 can be secured as described hereafter. The canopy 1 comprises three types of beams 3, 4, 5, namely:

- a beam 3 which on the outside of the canopy 1 serves as an external pivot bar 3;
- a beam 4 which centrally in the canopy 1 serves as a central pivot bar 4; and
- a beam 5 that serves as a clamping bar 5.

It will also be appreciated that the beams 3, 4, 5 can be secured to other structures, for example a wall or façade, rather than just columns 2 as shown in FIG. 1. In this way the canopy 1 can be generally used for protecting an outdoor space, as well as an indoor space.

Figure 2:
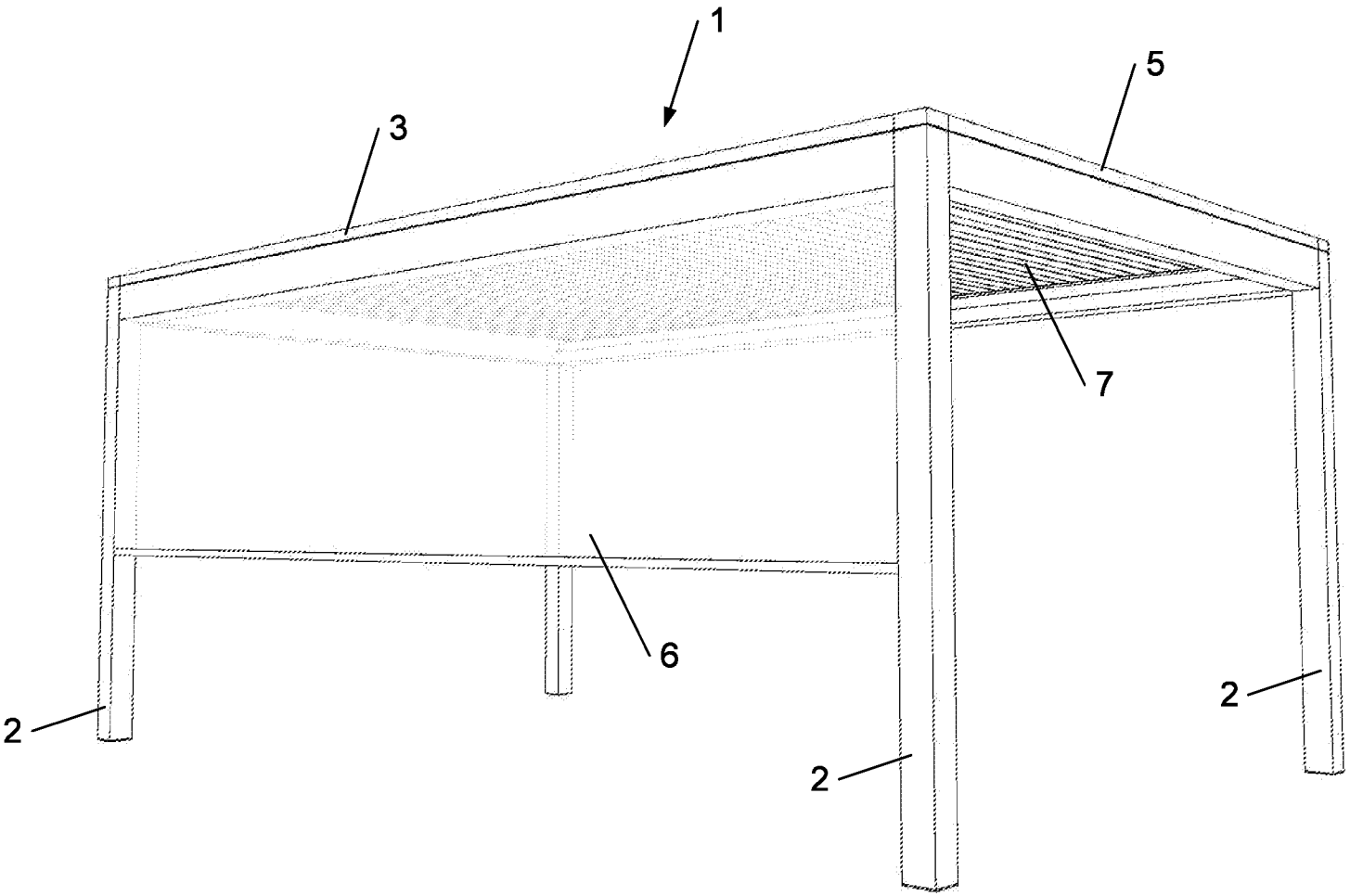
FIG. 2 shows a design of the canopy in more detail.

The canopy 1 shown in FIG. 2 comprises four support columns 2 which support a frame, also referred to as a roof frame. The frame is formed by two external pivot bars 3 and two clamping bars 5 between which a roof covering 7 is provided. Between two support columns 2 and a pivot bar 3 or clamping bar 5, a wall infill 6 can optionally be provided.

Wall infills 6 are typically intended to protect openings below the canopy 1 between the columns 2. The wall infills 6 can be fixed or moveable. Movable side walls comprise, for example, extendable and retractable screens and/or wall elements that are slidable in respect of each other, etc. Fixed side walls can be manufactured from various materials, such as plastic, glass, metal, textile, wood, etc. Combinations of different wall infills 6 are similarly possible. FIG. 2 illustrates a wall infill in the form of an extendable and retractable screen 6. The screen 6 extends between two adjacent columns 2 and can be extended from the external pivot bar 3. The screen 6 serves primarily as a wind and/or sun screen.

According to the present invention the roof covering 7 is formed by slats which at their tip extremities are rotatably secured to pivot bars 3. The slats are rotatable between an open position and a closed position. In the open position there is a gap between the slats through which, for example, light can be introduced into the space below, or leave this space below. In the closed state the slats form a closed canopy by means of which the space below can be protected from, for example, wind and/or precipitation, such as rain, hail or snow. To drain away precipitation the slats are typically set up sloping towards one of the two pivot bars 3.

The slats are typically manufactured from a rigid material. This can be aluminium, for example. Aluminium has many advantages as a material, because it is simultaneously tough and light, has good resistance to poor weather conditions and is low maintenance. However, other materials are also suitable and the advantages and disadvantages of these are assumed to be known by a skilled person. A slat can be produced using various techniques depending on the material, including extrusion, milling, folding, casting, welding, and so on. The appropriate production technique is assumed to be known by the skilled person. Preferably, the slats are manufactured by means of an extrusion process. Optionally, fill elements made, for example, of polycarbonate, glass, wood, and so on, can also be used to at least partially fill the hollow slats, for example to achieve a different appearance of the slat, in particular if the slat is manufactured from a transparent material such as glass.

Figure 3:
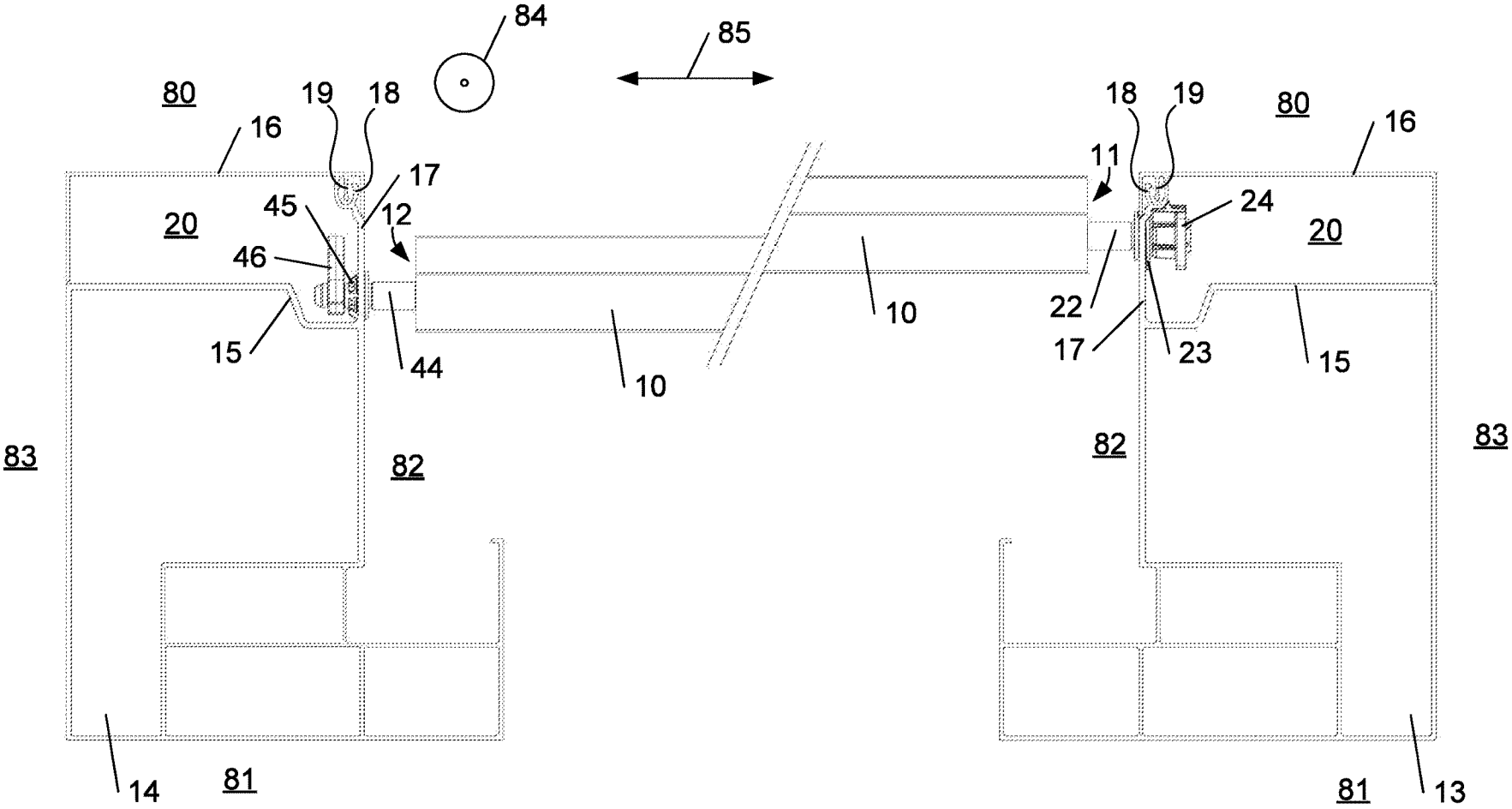
FIG. 3 shows a front view of the connection between the slat and the beams.

The invention will be further described with reference to FIGS. 3 to 9. FIG. 3 shows a front view of how a slat 10 of a slat roof according to the present invention is secured at both extremities 11, 12 to beams 13, 14. This figure also illustrates how the slats 10 are assembled with a slope such that they drain precipitation towards the second beam 14. In the embodiment shown, the beams 13, 14, are each formed by the combination of multiple profiles. For the present invention it is primarily the base profile 15 and the cover profile 16 that are of importance. The base profile 15 has an upright wall 17 with a groove 18 on the upper extremity thereof. The cover profile 16 is provided with a corresponding pin 19 that grips in an elastic element (not shown) provided in the groove 18 and serves to connect the cover profile 16 with the base profile 15 for the forming of the beam 13, 14. Below the cover profile 16 there is an interior space 20 in which electrical and/or electronic components can be provided for driving the slats 10. It should be obvious that a groove 18 and pin 19 can also be replaced by other connecting means.

In the remainder of the description, the following orientations are used as designated in FIG. 3. The slat roof, i.e. the beams 13, 14, generally has a topside 80, an underside 81, an inside 82 and an outside 83. The beams 13, 14 extend in a transverse direction emerging from the sheet of FIG. 3, whereas the slats 10 extend in a longitudinal direction 85.

Figure 4A:
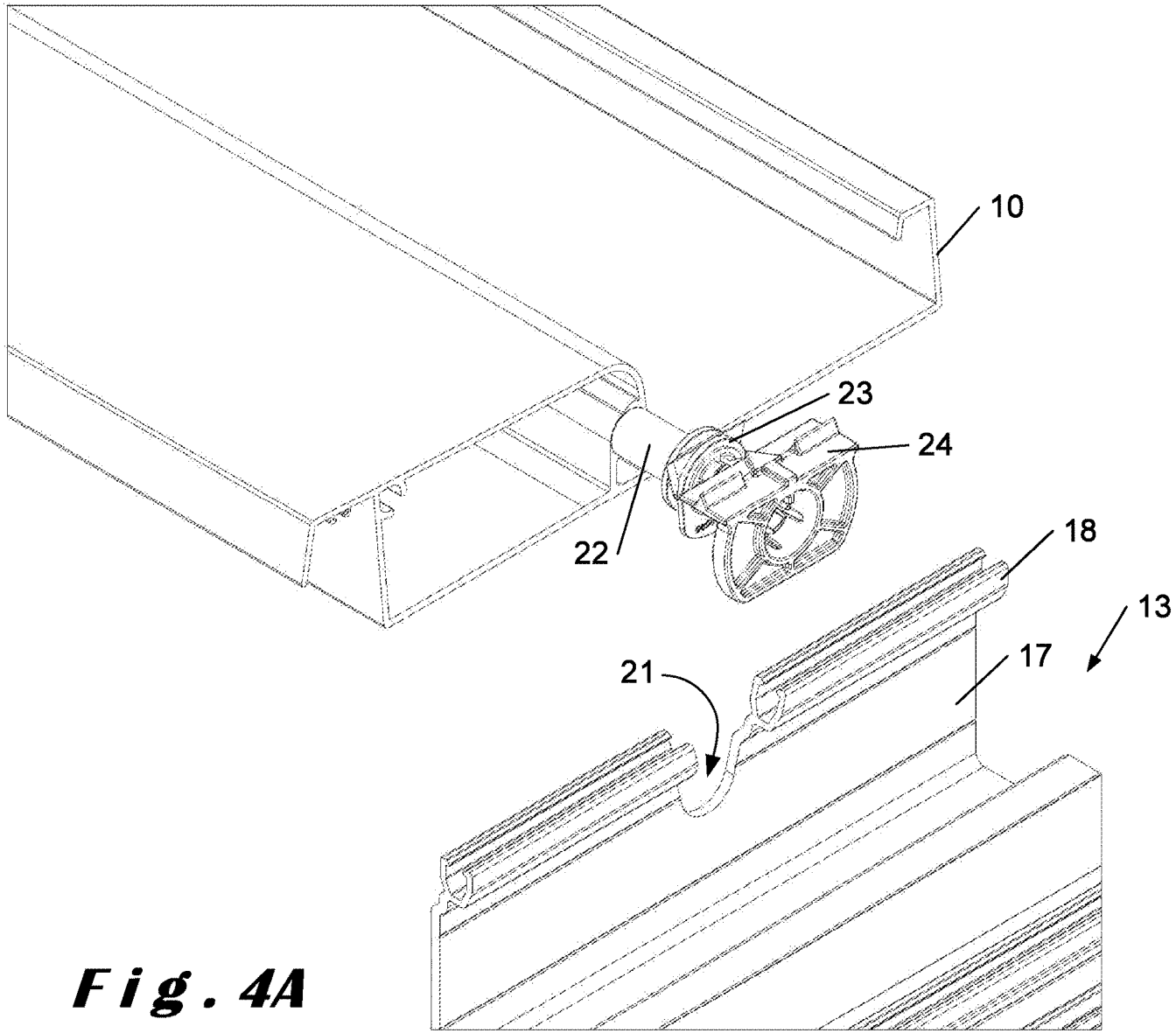
FIGS. 4A to 4C show a perspective view of the placement and locking of the first extremity of the slat in a first beam of the roof construction.

The fastening of the slat 10 to the first beam 13 will be described in more detail with reference to FIGS. 4A to 6B. FIG. 4A shows part of the first beam 13. This beam 13 is provided with a set of recesses 21 made in the upright wall 17 that are open towards the topside of the beam 13. These recesses 21 can, for example, be manufactured by milling or drilling. Because the recesses 21 are open towards the topside of the first beam 13, the groove 18 is therefore also interrupted at regular intervals. On its first extremity 11, the slat 10 is provided with a first slat shaft 22 on which a connection piece 23 with a locking part 24 thereon is secured. Typically, the slat shaft 22, the connection piece 23 and the securing part 24 are all already assembled in advance on the slat 10 to save time during assembly of the slat roof.

Figure 4B:
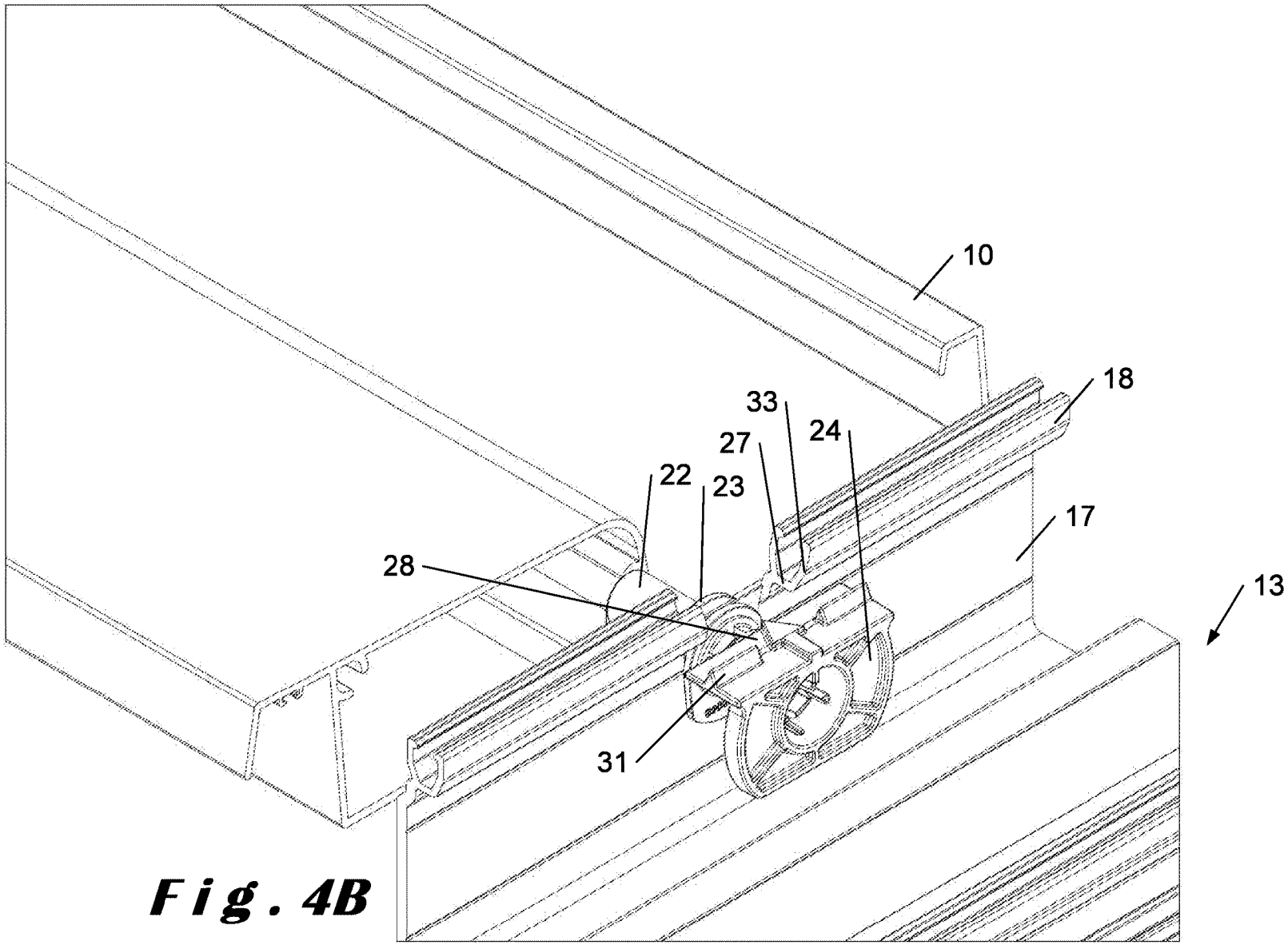
Figure 5B:
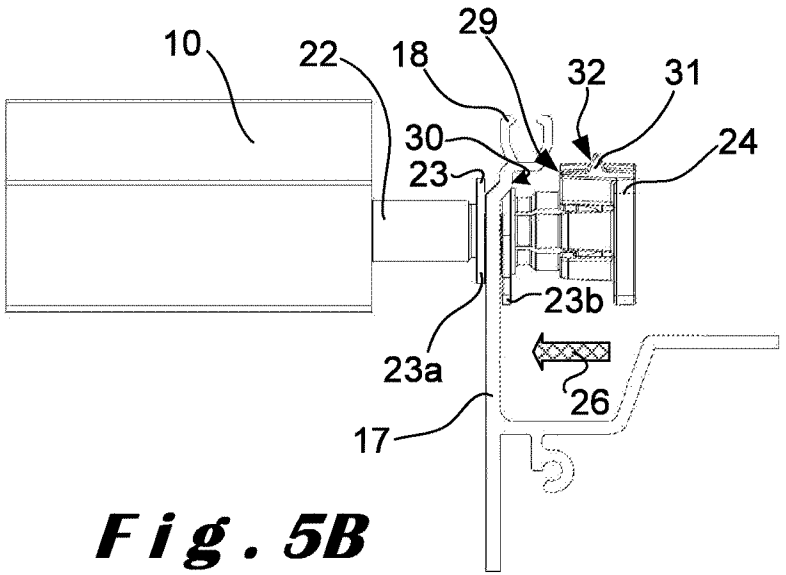
FIG. 5A to 5C show the same as FIGS. 4A to 4C in a frontal view.
Figure 5C:
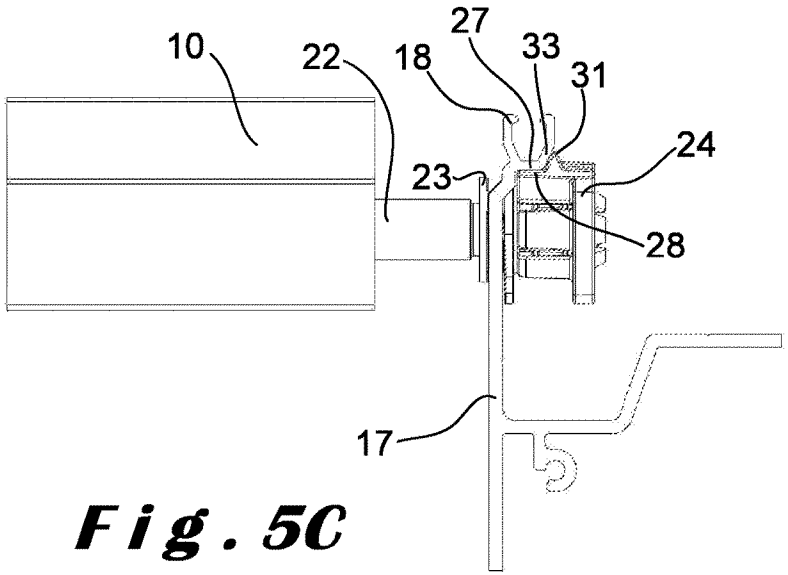
Figure 5A:
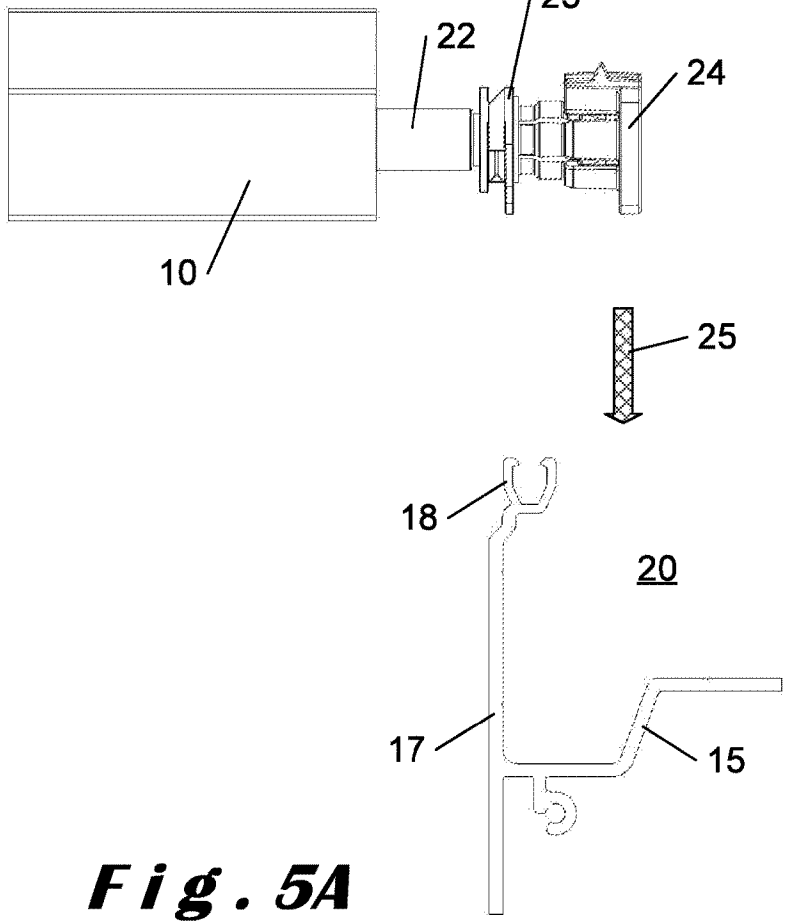
Figure 6B:
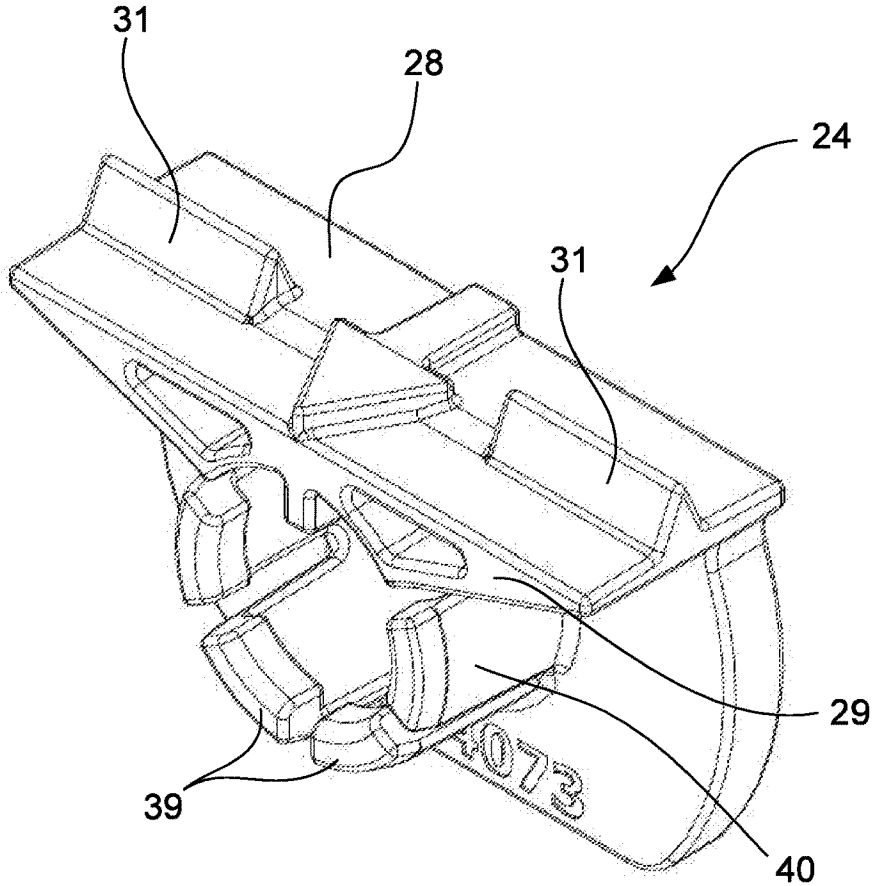
FIGS. 6A and 6B show a perspective view of the connection piece and the locking piece.
Figure 6A:
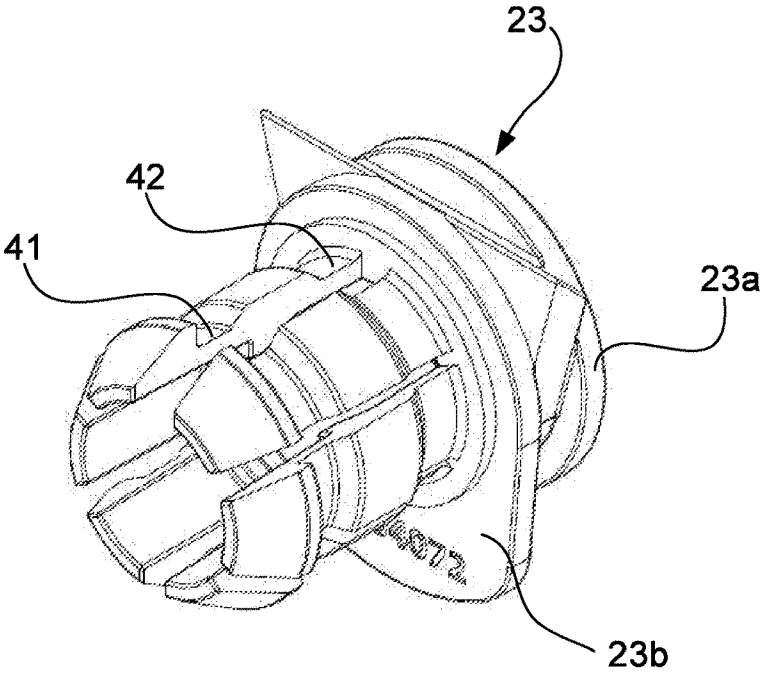

FIG. 5A shows a front view of the situation shown in FIG. 4A, i.e. the unassembled state of the slat 10. The arrow 25 indicates that the first extremity 11 of the slat 10 should be displaced downwards such that the connection piece 23 comes to rest in the recess 21 as shown in FIG. 4B.

For the positioning of the connection piece 23 in relation to the first beam 13, the connection piece 23 is provided with two transversally oriented walls 23*a*, 23*b* between which the upright wall 17 of the first beam 13 partially protrudes. In this way, the axial position (i.e. in the longitudinal direction 85 of the slat 10) of the connection piece 23 in relation to the first beam 13 is substantially fixed within a certain tolerance (for example, approximately 5 mm). A downward displacement of the connection piece 23 in relation to the first beam 13 is also limited because the connection piece 23 rests on the underside of the U-shaped recess 21.

Figure 4C:
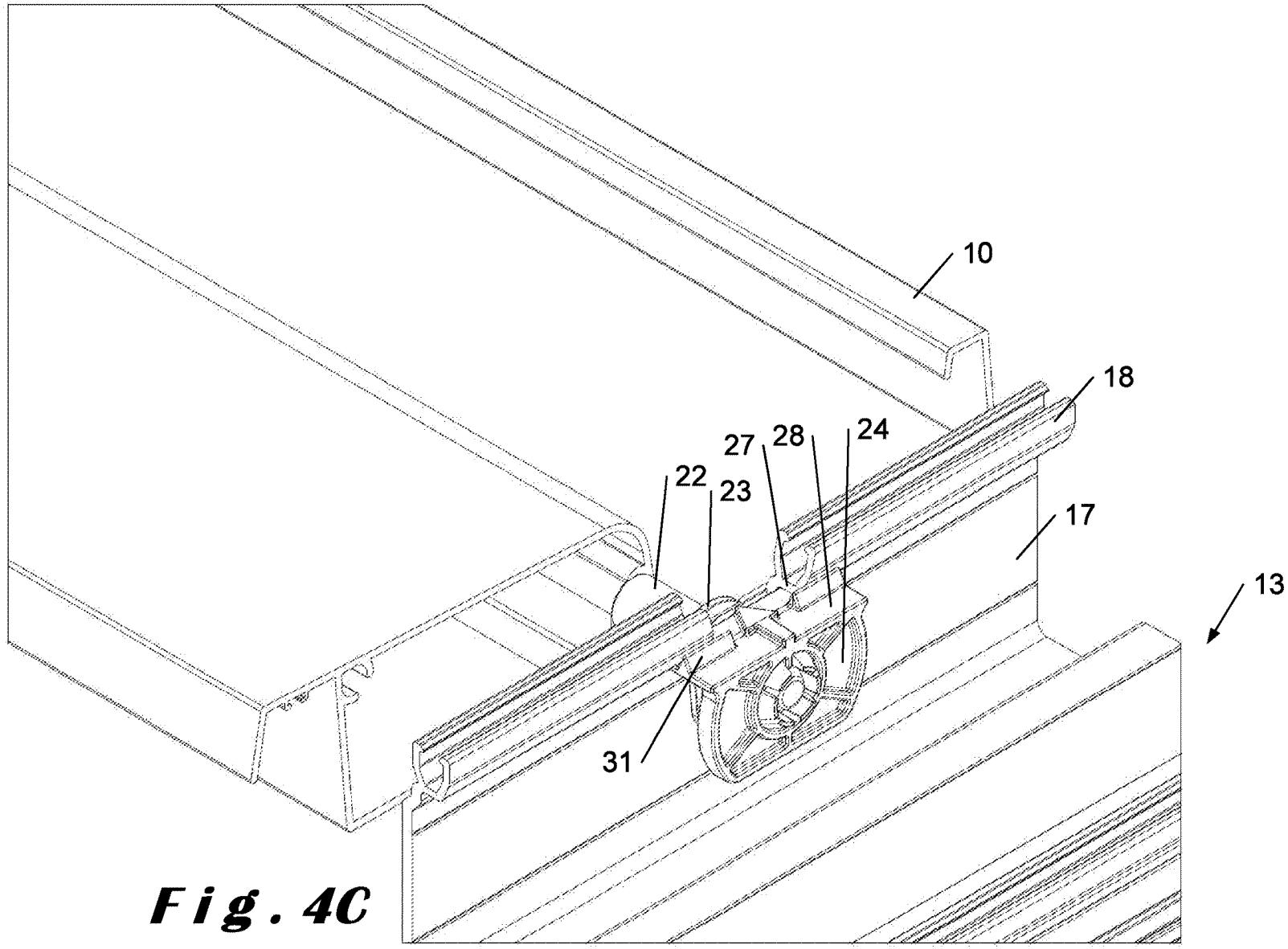

FIG. 5B shows a front view of the situation shown in FIG. 4B, i.e. the non-vertical-locked state of the slat 10. The arrow 26 indicates that the locking piece 24 should be displaced from its loose state (FIG. 5B) towards the slat 10 into its locked state (FIG. 5C) to grip below the groove 18 as shown in FIGS. 4C and 5C. In this way, the bottom wall 27 of the groove 18 forms an abutment for the substantially flat topside wall 28 of the locking piece 24. FIG. 4C clearly shows that the topside wall 28 of the locking piece 24 on both sides of the recess 21 is locked below the bottom wall 27 of the groove 18 that forms part of the first beam 13. Following displacement of the locking piece 24 into its locked state, it is therefore no longer possible to displace the locking piece 24 upwards in relation to the first beam 13 because the walls 27, 28 prevent this. The walls 27, 28 also prevent a rotation of the locking piece 24 about the longitudinal direction 85 in relation to the beam 13.

The locking piece 24 also contributes to the lateral securing of the slat 10 in relation to the beam 13. The fact is that the most inwardly directed wall 29 (see FIG. 6B) abuts against a part of the perimeter wall 30 of the first beam 13 near the recess 21 (i.e. the part of the upright wall 17 that extends around the recess 21). Furthermore, the locking piece 24 is also provided with a transversally oriented protrusion 31 extending towards the topside 80 of the topside wall 28. This protrusion 31 has a sloping wall 32 (see FIG. 5B) that corresponds with a sloping wall section 33 (see FIG. 5C) of the groove 18 in the first beam 13. The sloping wall sections 32, 33 also contribute both to the vertical and the lateral locking of the slat 10 in relation to the beam 13.

Figure 8A:
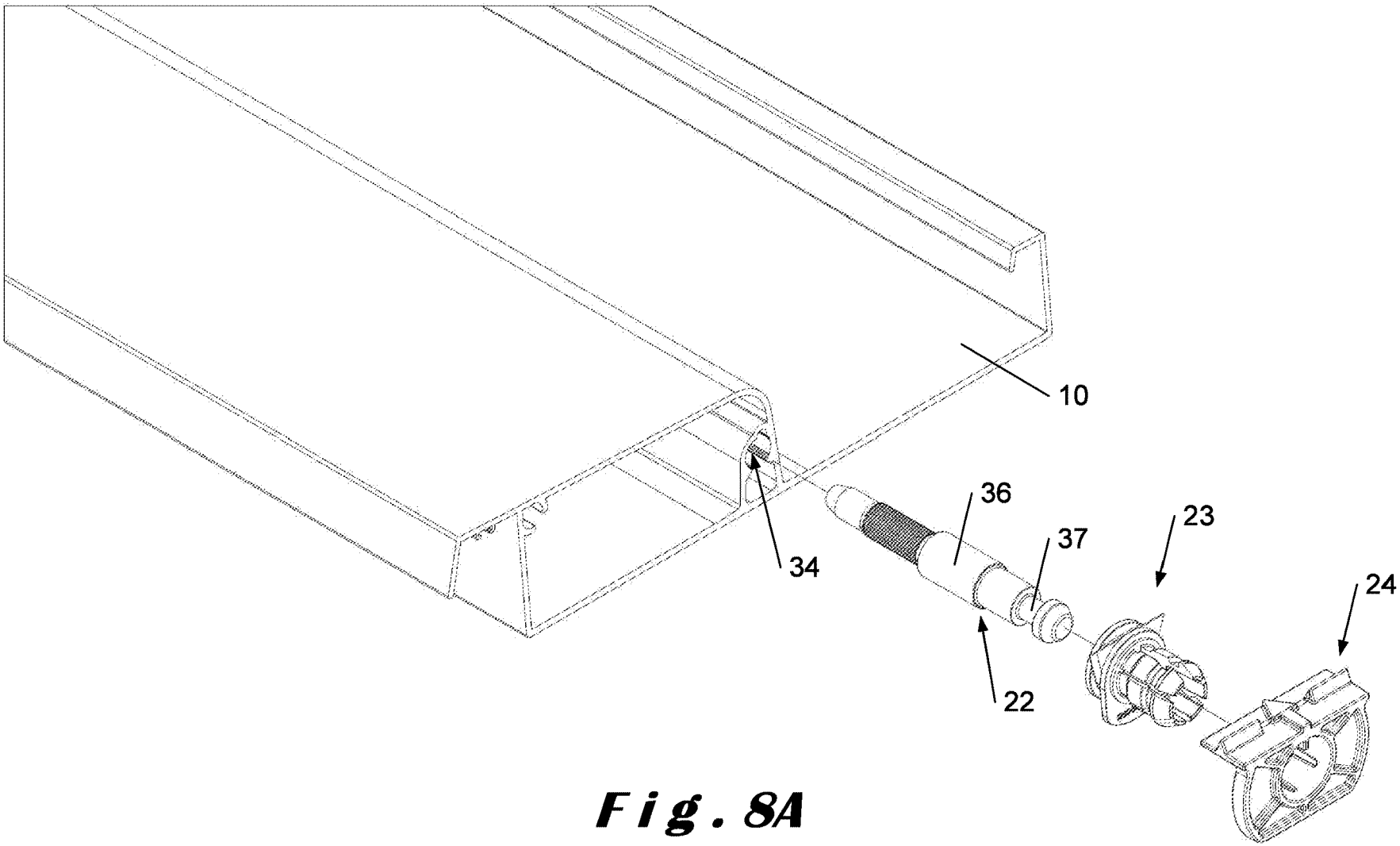
FIGS. 8A and 8B show an exploded view of the first, or second, extremity of the slat.
Figure 9A:
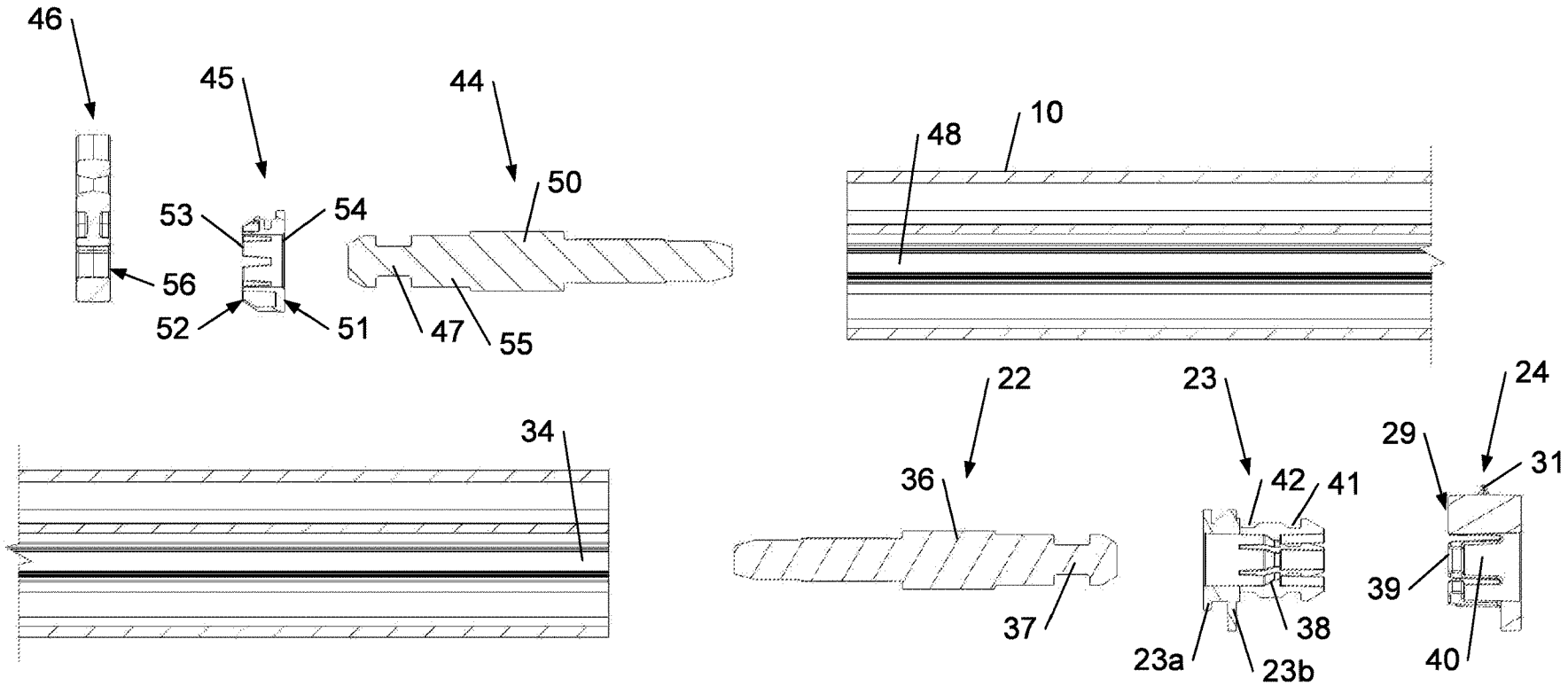
FIGS. 9A and 9B show a cross-section of the slat in both exploded and assembled view.
Figure 9B:
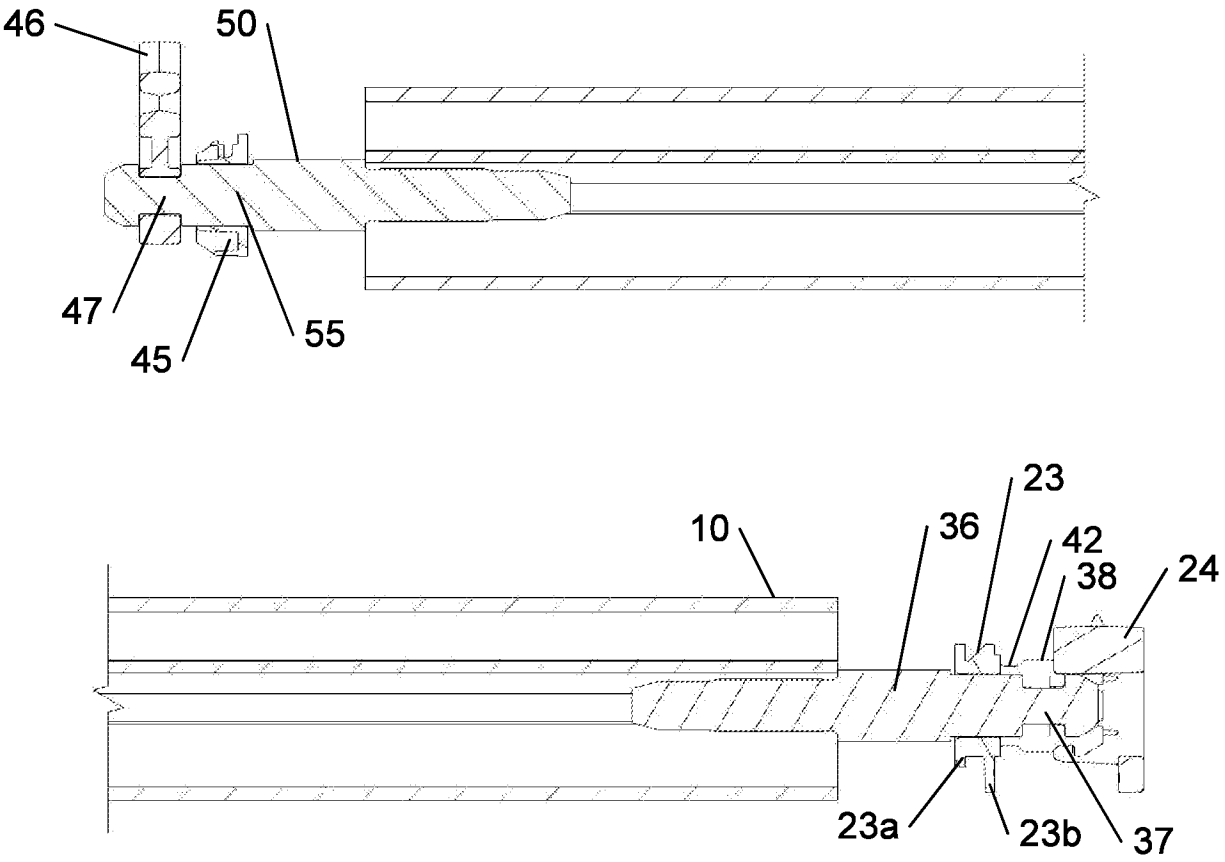

The securing together of the slat 10, the slat shaft 22, the connection piece 23 and the securing part 24 is shown in FIGS. 8A, 9A and 9B. The slat 10 is typically provided with a slat channel 34 in which part of the slat shaft 22 is firmly attached. The slat shaft 22 is provided with a central camber 36 that on one side joins the first extremity 11 of the slat 10 and on the other side is positioned against the connection piece 23. The connection piece 23 is substantially annular and the interior wall 23*a* abuts against the central camber 36. Further towards the outside the slat shaft 22 is provided with a groove 37 in which a part of the connection piece 23 grips. More specifically, the connection piece 23 is provided within the annular part with flexibly deformable hooks 38. When the connection piece 23 is slid over the slat shaft 22 these hooks 38 contract in order to grip in the groove 37 such that the connection piece 23 becomes firmly attached to the slat shaft 22. In another embodiment the connection piece 23 is manufactured as an integral part with the slat shaft 22.

Similarly to the connection piece 23, the locking piece 24 is also partly annular such that the locking piece 24 can slide over the connection piece 23. The locking piece 24 is provided with hooks 39 that are secured to the extremities of flexible arms 40. In the loose state the hooks 39 grip in a first groove 41 provided on the circumferential wall of the connection piece 23, whereas, in the locked state, the hooks 39 grip in a second groove 42 provided on the circumferential wall of the connection piece 23. The use of hooks 39 and grooves 41, 42 ensures a rapid and simple displacement of the securing part 24 between its different states.

Figure 7B:
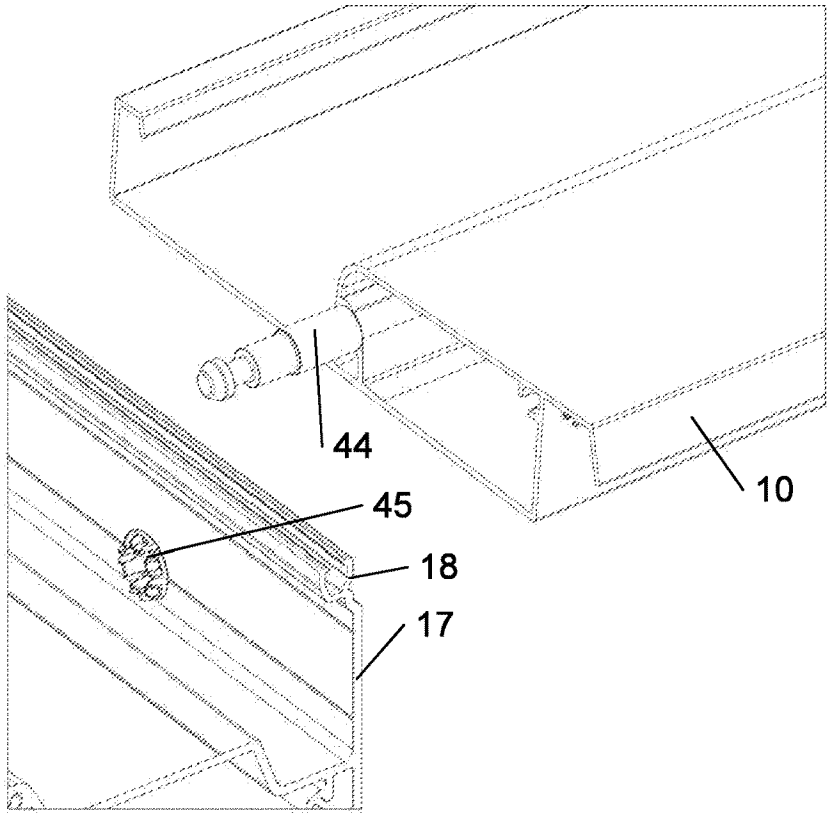
FIGS. 7A to 7D show a perspective view of the placement and locking of the second extremity of the slat in a second beam of the roof construction.
Figure 7A:
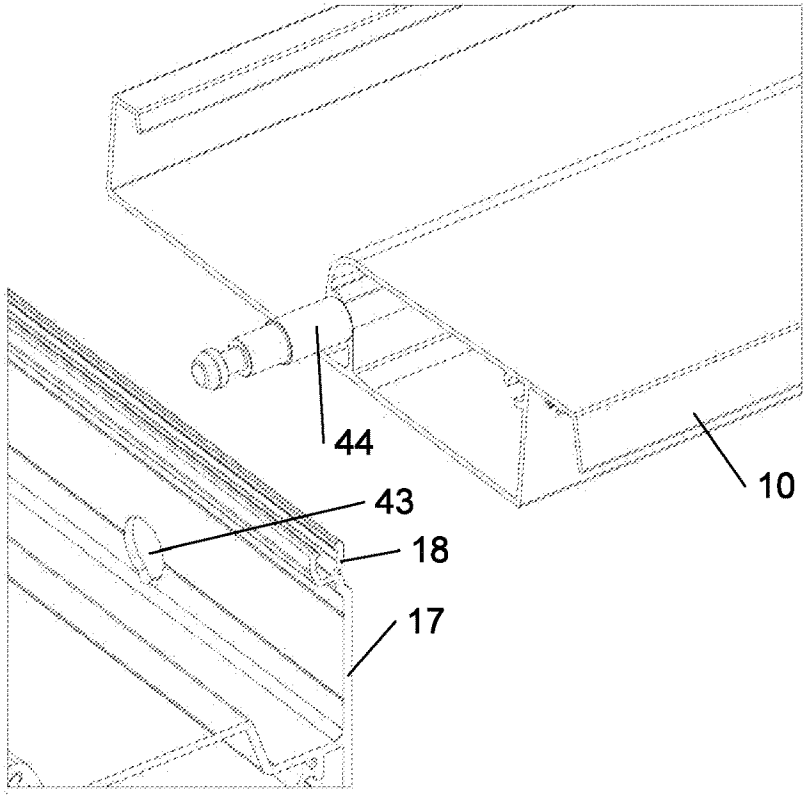

The securing of the slat 10 to the second beam 14 will be described in more detail with reference to FIGS. 7A to 7D. FIG. 7A shows a section of the second beam 14. This beam 14 is provided with a set of recesses 43 made in the upright wall 17. These openings 43 can, for example, be manufactured by milling or drilling. On its second extremity 12 the slat 10 is provided with a second slat shaft 44, which in the design shown is identical to the first slat shaft 22. A bearing piece 45 is passed through the openings 43 such that the slat shaft 44 can rotate smoothly in relation to the second beam 14 (as shown in FIG. 7B). Typically, the slat shaft 44 is already assembled in advance on the slat 10 and the bearing piece 45 is already assembled in advance on the second beam 14 to save time during assembly of the slat roof.

Figure 7D:
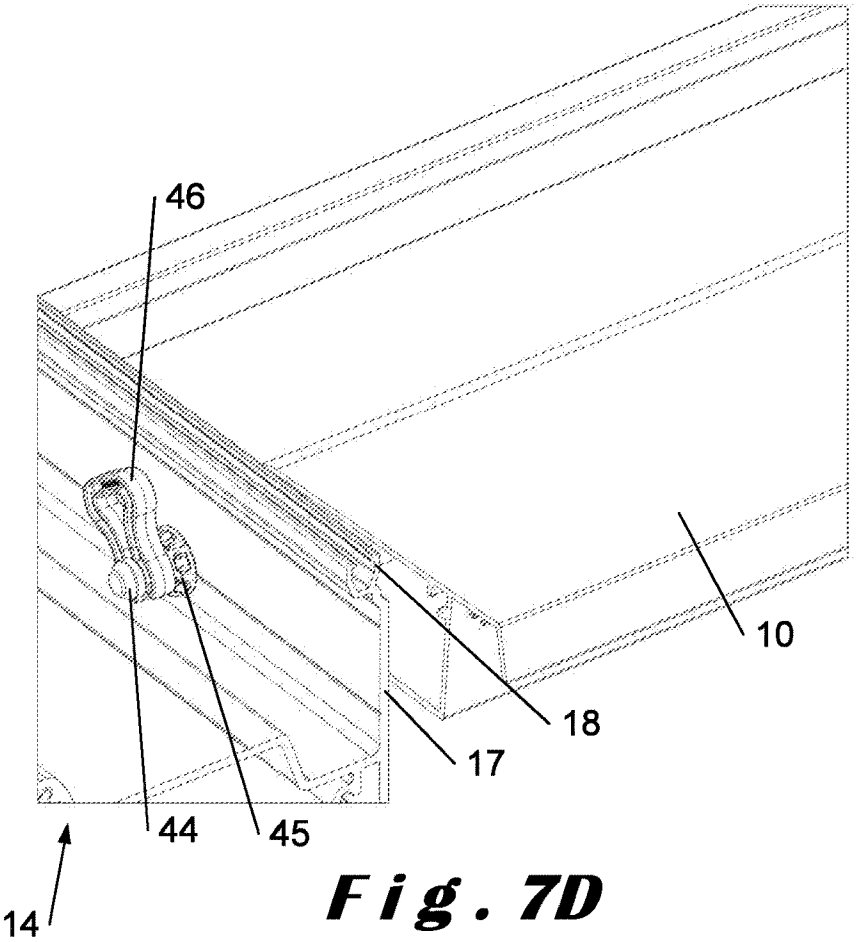
Figure 7C:
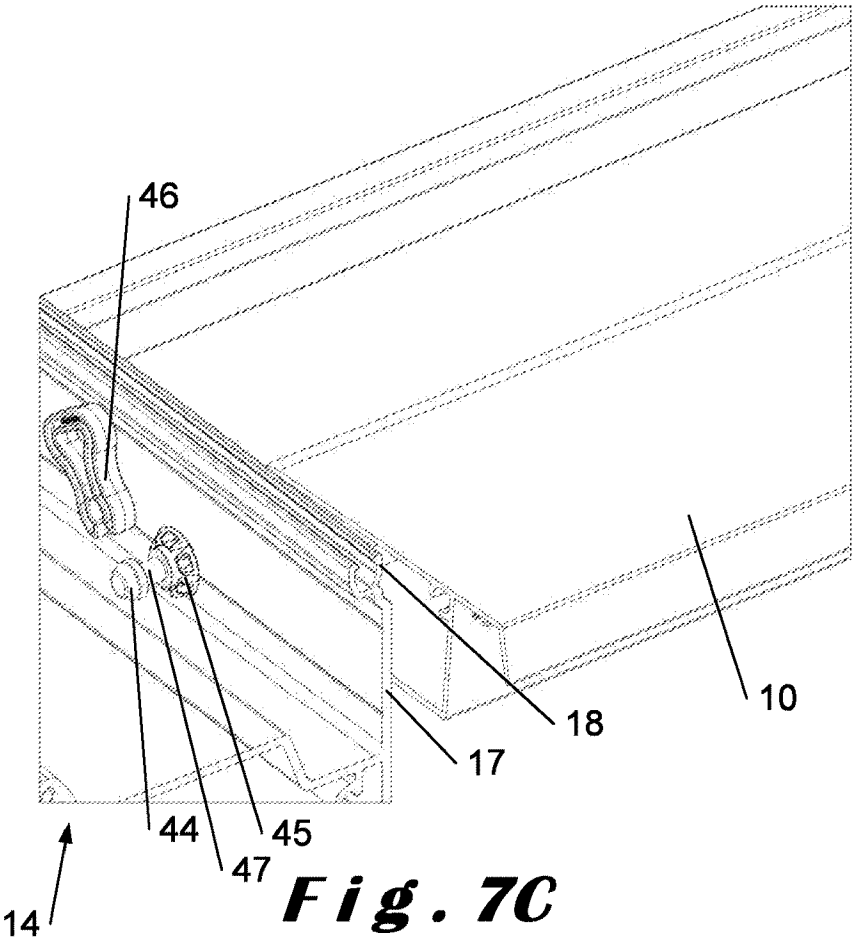

In a first assembly step, the slat shaft 44 is passed through one of the openings 43 as shown in FIG. 7C. Then, a positioning element 46, in particular a clip, is placed over the slat shaft 44 against the transversally oriented wall of the bearing piece 45 as shown in FIG. 7D. In particular, the clip 46 is placed in a groove 47 provided in the slat shaft 44. The clip 46 prevents the bearing piece 45 from being able to shift towards the outside 83 in relation to the slat shaft 44.

As best shown in FIG. 3, the slat 10, together with the locking piece 24 on one side and the bearing piece 45 and the positioning element 46 (i.e. the clip) on the other side, ensures lateral locking of the beams 13, 14. The fact is that both the locking piece 24 and the bearing piece 45 are in a fixed position (in the case of the bearing piece 45 this fixed positioning is the result of the clip 46) in relation to the slat 10 in the longitudinal direction 85. Given that the first beam 13 laterally abuts against the locking piece 24 when there is a displacement towards the outside 83 and the second beam 14 abuts against the bearing piece 45 when there is a displacement towards the outside 83, the outward bulging of the beams 13, 14 is therefore avoided.

Figure 8B:
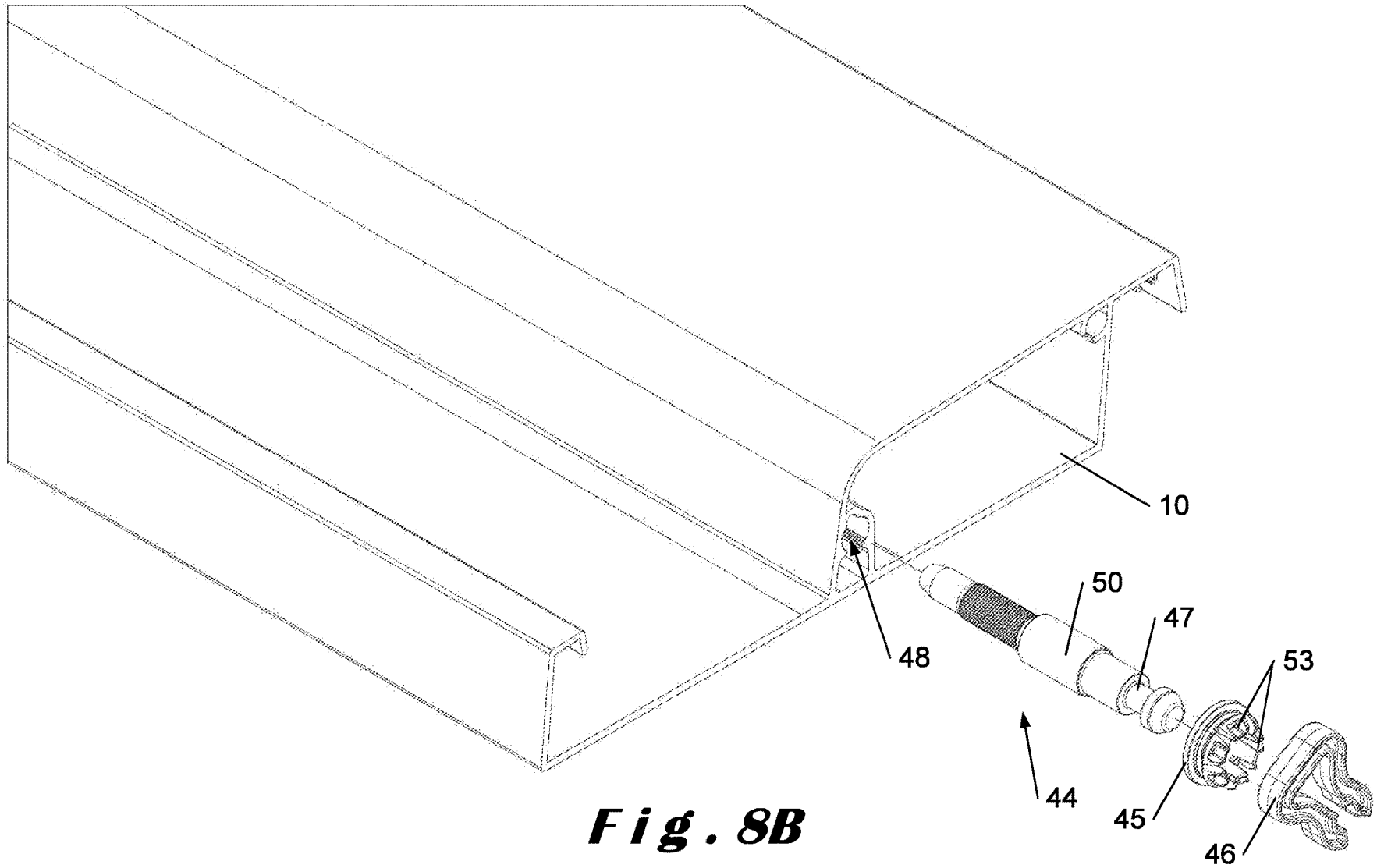

The securing together of the slat 10, the slat shaft 44, the bearing piece 45 and the clip 46 is shown in FIGS. 8B, 9A and 9B. The slat 10 is typically provided with a slat channel 48 in which part of the slat shaft 44 is firmly attached. The slat shaft 44 is provided with a central camber 50 that on one side abuts against the second extremity 12 of the slat 10 and on the other side is positioned on a transversal wall 51 of the bearing piece 45. The bearing piece 45 is substantially annular and mounted in an opening 43 in the upright wall 17 of the second beam 14. More specifically, the bearing piece 45 is pushed from the inside 82 of the second beam 14 through the opening 43, wherein the flexible arms 53 partially fold inwards and then rebound and grip on the outwardly directed side of the upright wall 17 such that the upright wall 17 is positioned in the groove 54 provided on the circumferential wall of the bearing piece 45.

The slat shaft 44 has a section 55 located on the outside of the central section 50 and having a smaller diameter. This section 55 extends through the bearing piece 45 as shown in FIG. 9B. To prevent a longitudinal shift of the bearing piece 45 in relation to the slat shaft 44, the clip 46 is positioned in a groove 47 of the slat shaft 44, wherein the clip 46, in particular a transversally oriented wall 56 formed by the inwardly directed side of the clip 46, abuts against the bearing piece 45, in particular against a corresponding transversally oriented wall 52 formed by the inwardly directed side of the bearing piece 45. The clip 46 can be rapidly and simply positioned in the groove 47 of the slat shaft 44 and can also be rapidly and simply removed such that the slat 11 can be disconnected from the second beam 14.

In an embodiment that is not shown, no bearing piece 45 is provided in the second beam 14. In such a design, the positioning element 46 is directly secured against the upright wall 17 of the second beam 14, for example by providing the groove 47 in the slat shaft 44 nearer the second extremity 12 of the slat 10.

It should be obvious that the first and the second slat shaft 21, 22 can also form part of the same shaft that extends through the entire slat 10. The first slat shaft is then formed by one extremity of the continuous slat shaft and the second slat shaft is then formed by the other extremity of the continuous slat shaft.

It should also be obvious that although the invention is described with reference to a roof construction with a first beam with recesses and a second beam with openings, it is possible to provide recesses in both beams in order, at both extremities 11, 12 of the slat 10, to use a locking piece 24 with a corresponding vertical abutment.

It should be obvious that the recess 21 can also have a form other than the semi-circular form shown. In particular, it is possible to use moon-shaped, rectangular, triangular, hexagonal, octagonal, etc. forms. These forms have in common that their greatest width is at the topside of the recess after which the width constantly reduces as far as the lowest point in the recess and wherein the slat shaft then lies below the recess as a result of gravity. However, other forms of the recess are also possible, for example a recess the width of which increases in relation to the width at the topside of the topside. Forms are also possible wherein the lowest point of the recess is shifted in relation to the open extremity of the recess at the topside of the beam, for example an L-shaped or hook-shaped recess. In such a design, a topside wall of the recess (e.g. the lowest leg of an L-shaped recess) can serve as an abutment for the locking piece.

Although certain aspects of the present invention are described in relation to specific embodiments, it is clear that these aspects can be implemented in other forms within the scope of protection as provided for by the claims.

The invention claimed is:

1. A slat roof for a canopy, wherein the slat roof comprises:

a frame comprising a first beam and a second beam which are substantially parallel and extend in a transverse direction, wherein the first and second beams have a topside, an underside, an inside and an outside, wherein the insides of the first and second beams face each other and wherein the first beam is provided with a set of recesses that are open towards the topside of the first beam; and a set of parallel slats positioned between and rotatably secured to the first and second beams, wherein the slats extend in a longitudinal direction and are provided with a first extremity with a first slat shaft and a second extremity with a second slat shaft, wherein each of the first slat shafts is passed through a corresponding one of the set of recesses, wherein the first beam, near to at least one recess from the set of recesses, is provided with an abutment and in that the first slat shaft that is placed in the at least one recess is provided with a locking piece having a topside that at least partially abuts against the abutment, wherein the abutment is at least partially formed by a substantially flat wall section of the first beam and in that the locking piece, on the topside thereof, has a corresponding substantially flat wall section, wherein the locking piece comprises a protrusion extending towards the topside of the first beam from the substantially flat wall section, wherein the first beam is provided with a sloping wall section that substantially joins the substantially flat wall section of the first beam, and wherein the protrusion has a corresponding sloping wall section that abuts against the sloping wall section.

2. The slat roof according to claim 1, wherein the locking piece has a transversally, in relation to the longitudinal direction, oriented wall that on an inside thereof at least partially abuts against the first beam.

3. The slat roof according to claim 1, wherein the slat shaft that is placed in the recess is provided with a connection piece that is placed in the recess, wherein the locking piece is secured by means of the connection piece to the slat shaft.

4. The slat roof according to claim 3, wherein the locking piece is displaceable in relation to the connection piece in the longitudinal direction between a loose state and a locked state, wherein, in the locked state, the locking piece at the topside thereof at least partially abuts against the abutment and, in the loose state, the locking piece does not touch against the abutment.

5. The slat roof according to claim 4, wherein the locking piece is provided with a first connecting means and the connection piece is provided with a second and a third connecting means, wherein, in the loose state, the locking piece is positioned on the connection piece by means of the first and the second connecting means and wherein, in the locked state, the locking piece is positioned on the connection piece by means of the first and the third connecting means.

6. The slat roof according to claim 5, wherein the first connecting means is formed by at least one hook, the second connecting means is formed by at least one notch corresponding with the hook and the third connecting means is formed by at least one further notch corresponding with the hook, wherein, when displacing the locking piece from a loose state to a locked state, the at least one hook at least partially undergoes a transversal displacement in relation to the longitudinal direction.

7. The slat roof according to claim 6, wherein the notch and/or the further notch are formed by a groove in a circumferential wall of the connection piece.

8. The slat roof according to claim 5, wherein the locking piece is formed by an annular body, wherein the first connecting means is secured to the annular body by means of an arm extending in the longitudinal direction.

9. The slat roof according to claim 3, wherein the connection piece has a transversally, in relation to the longitudinal direction, oriented wall that at least partially abuts against a perimeter wall of the recess.

10. The slat roof according to claim 3, wherein the locking piece and/or the connection piece are manufactured as an integral part, in particular by means of injection moulding, from a plastic.

11. The slat roof according to claim 1, wherein the first beam, near to multiple recesses from the set of recesses, is provided with an abutment and in that the slat shafts that are placed in the recesses are each provided with a locking piece having a topside that at least partially abuts against a corresponding one of the abutments.

12. The slat roof according to claim 11, further including a plurality of stops that are formed by means of a substantially flat wall section extending in the transverse direction.

13. A slat roof for a canopy, wherein the slat roof comprises:

a frame comprising a first beam and a second beam which are substantially parallel and extend in a transverse direction, wherein the first and second beams have a topside, an underside, an inside and an outside, wherein the insides of the first and second beams face each other and wherein the first beam is provided with a set of recesses that are open towards the topside of the first beam; and a set of parallel slats positioned between and rotatably secured to the first and second beams, wherein the slats extend in a longitudinal direction and are provided with a first extremity with a first slat shaft and a second extremity with a second slat shaft, wherein each of the first slat shafts is passed through a corresponding one of the set of recesses, wherein the first beam, near to at least one recess from the set of recesses, is provided with an abutment and in that the first slat shaft that is placed in the at least one recess is provided with a locking piece having a topside that at least partially abuts against the abutment, wherein the second beam is provided with a set of openings, wherein each of the second slat shafts is passed through a corresponding opening in the set of openings, and wherein at least one second slat shaft of the second slat shafts is provided with a positioning element, in particular a clip, that directly or indirectly abuts against a perimeter wall of the second beam around the opening through which the second slat shaft is passed.

14. The slat roof according to claim 13, wherein the second slat shaft is provided with a transversally, in relation to the longitudinal direction, oriented wall against which the positioning element at least partially abuts upon displacement thereof towards the outside of the second beam.

15. The slat roof according to claim 14, wherein the transversally oriented wall is formed by a groove in the second slat shaft.

16. The slat roof according to claim 13, wherein a bearing piece extends through the opening through which the second slat shaft is passed, wherein the positioning element abuts against the bearing piece.

17. The slat roof according to claim 16, wherein the bearing piece is provided with a groove in a circumferential wall thereof, wherein a section of the second beam is located in the groove.

18. The slat roof according to claim 13, wherein multiple of the second slat shafts are provided with a positioning element, in particular a clip, that directly or indirectly abuts against a perimeter wall of the second beam around the opening through which the second slat shaft is passed.

19. A kit of parts for assembling a slat roof according to claim 1, wherein the kit comprises the frame, the first beam, the second beam, the slats and the locking piece.

20. A canopy comprising a slat roof, the slat roof comprising:

a frame comprising a first beam and a second beam which are substantially parallel and extend in a transverse direction, wherein the first and second beams have a topside, an underside, an inside and an outside, wherein the insides of the first and second beams face each other and wherein the first beam is provided with a set of recesses that are open towards the topside of the first beam; and a set of parallel slats positioned between and rotatably secured to the first and second beams, wherein the slats extend in a longitudinal direction and are provided with a first extremity with a first slat shaft and a second extremity with a second slat shaft, wherein each of the first slat shafts is passed through a corresponding one of the set of recesses, wherein the first beam, near to at least one recess from the set of recesses, is provided with an abutment and in that the first slat shaft that is placed in the at least one recess is provided with a locking piece having a topside that at least partially abuts against the abutment, wherein the first beam, near to at least one recess from the set of recesses, is provided with an abutment and in that the first slat shaft that is placed in the at least one recess is provided with a locking piece having a topside that at least partially abuts against the abutment, wherein the second beam is provided with a set of openings, wherein each of the second slat shafts is passed through a corresponding opening in the set of openings, and wherein at least one second slat shaft of the second slat shafts is provided with a positioning element, in particular a clip, that directly or indirectly abuts against a perimeter wall of the second beam around the opening through which the second slat shaft is passed.

* * * * *